United States Patent [19]

Ganter et al.

[11] 4,244,038

[45] Jan. 6, 1981

[54] WATCH HAVING ADJUSTABLE DATE AND DAY INDICATORS

[75] Inventors: Wolfgang Ganter, Schramberg; Albert Ginter, Lauterbach; Josef King, Schramberg; Peter Riis, Deisslingen, all of Fed. Rep. of Germany

[73] Assignee: Gebruder Junghans GmbH, Schramberg, Fed. Rep. of Germany

[21] Appl. No.: 104,391

[22] Filed: Dec. 17, 1979

[30] Foreign Application Priority Data

Dec. 23, 1978 [DE] Fed. Rep. of Germany ..... 2855898

[51] Int. Cl.[3] ..... G04B 19/24; G04B 27/00

[52] U.S. Cl. ..... 368/35; 368/37

[58] Field of Search ..... 368/34, 35, 37, 38; 368/28, 31

[56] References Cited

U.S. PATENT DOCUMENTS 3,659,413 5/1972 Tanaka et al. ..... 368/34

3,702,530 11/1972 Besson et al. ..... 368/35

4,127,985 12/1978 Mürle et al. ..... 368/35

*Primary Examiner*—Vit W. Miska

*Attorney, Agent, or Firm*—Burns, Doane, Swecker & Mathis

[57] ABSTRACT

A watch contains a date indicator ring and a day of week indicator ring. A switching wheel is displaceable selectively into meshing engagement with the indicator rings to effect adjustment thereof. The switching wheel is actuated by a shaft which is axially displaceable between selection and working positions. In its selection position, the shaft can be rotated in either direction to selectively place the switching wheel in one of two preliminary locations corresponding to a date ring adjustment location and a day of week ring adjustment position. By then axially displacing the shaft to its working position, the switching wheel is displaced to a final location to effect the previously selected mode of adjustment. Such adjustment is effected by rotating the shaft in either direction to rotate the respective indicator ring in either direction.

9 Claims, 7 Drawing Figures

WATCH HAVING ADJUSTABLE DATE AND DAY INDICATORS

BACKGROUND OF THE INVENTION

The invention concerns a clock, more particularly, a wristwatch, having an adjustable date wheel and day-of-week wheel.

One type of clock is well known for German DE-AS 22 53 505. The selection device in this well-known clock comprises a pivoted detent hinged on the frame of the clockwork which can be actuated in a way such that, when the adjusting shaft is in the selector position, the pivoted detent can be brought into one or the other of two possible positions, depending upon the direction of shaft rotation. Further, this pivoted detent can be pivoted from the originally chosen selector position into one of two possible work positions by shifting the positioning shaft from its selector position into its work position.

The adjusting device of this well-known clock is, however, constructed such that, independently of the direction of turn of the adjusting shaft, only one simultaneous correction of the date and week day indicator or alternatively only one correction of the date indicator is possible. Further, this adjusting device of the well-known clock is designed such that an adjustment of the position of each indicator part is always possible in only one direction.

It is therefore the object of the invention to produce a clock with an adjusting mechanism for the week day and date rings wherein the adjusting mechanism makes possible an independent adjustment of the position of the date indicator ring as well as also the week day indicator ring and additionally, a correction of each of the two indicator rings is possible in both directions, i.e., at any given time forward and backward. In addition, the design of the adjusting mechanism to be produced should enable the user of the clock to properly preselect, without difficulty, the indicator made to be adjusted, i.e., week day or date.

SUMMARY OF THE INVENTION

This object is solved according to the claimed invention wherein the adjusting mechanism provides the user with a clock whose week day and date indicators can be simply and reliably adjusted. The user, in the event an adjustment of the date of week day indicator is required, has first to orient the adjusting shaft in its selector position, corresponding to the normal pressed-in position, and then to turn it in one or the other direction in order to preselect the indication mode to be adjusted. The selector mechanism according to the invention is brought to the associated selector mode position by this rotation of the adjusting shaft. If the user of the clock now pulls the adjusting shaft out into the so-called working position corresponding to the first retraction position, he can adjust the previously preselected indicator by a subsequent turn of the adjusting shaft into the desired position forward or backward. In this regard, a control mechanism in the clock assigned to the selector mechanism shifts a mesh either with the gear-tooth system of a date indicator ring or the gear-tooth system of a week day indicator ring.

In a second retraction position of the adjusting shaft which, however, does not constitute the subject of the invention, the user can also set the hand in the customary manner.

After ending an adjustment process, i.e., after pressing the adjusting shaft again into its normal position, the continuous switching wheel is again out of mesh with the gear-tooth system of the date or week indicator ring, respectively, and remains held in a neutral position so that the continuous switching operation for the two indicator rings controlled on the work side remains completely unaffected by the adjusting device according to the invention.

THE DRAWING

The following is a more detailed description of the invention on the basis of a form of construction shown in the drawing wherein:

FIG. 1 depicts a clock interior in plan, with the adjusting mechanism according to the invention in a first position, FIG. 2 depicts the clock of FIG. 1 with the adjusting mechanism according to the invention in a second position, FIG. 3 depicts the clock of FIG. 1 with the adjusting mechanism according to the invention in a third position, FIG. 4 depicts the clock of FIG. 1 with the adjusting mechanism according to the invention in a fourth position, FIG. 5 is a cross section through the clock taken along cross section line V—V in FIG. 1, FIG. 6 is a cross section through the clock taken along cross section line VI—VI in FIG. 1, FIG. 7 is a cross section through the clock taken along cross section line VII—VII in FIG. 1.

In the figures, the same construction components are provided with the same reference numbers. In addition, in the figures, only the part of the clock affecting the adjusting mechanism is shown whereby, for the sake of better viewing, the representation of further clock work parts has been omitted.

DETAILED DESCRIPTION OF A PREFERRED EMBODIMENT OF THE INVENTION

Figure 5:
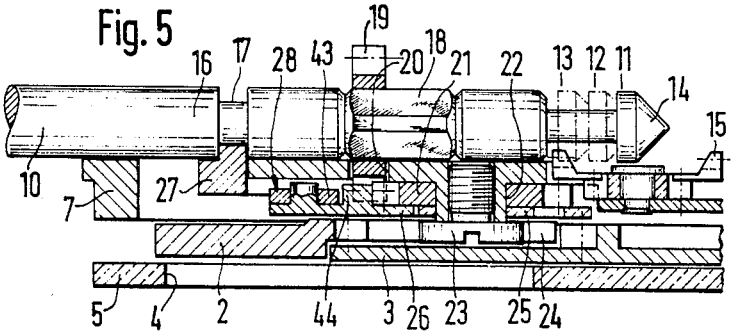
Figure 6:
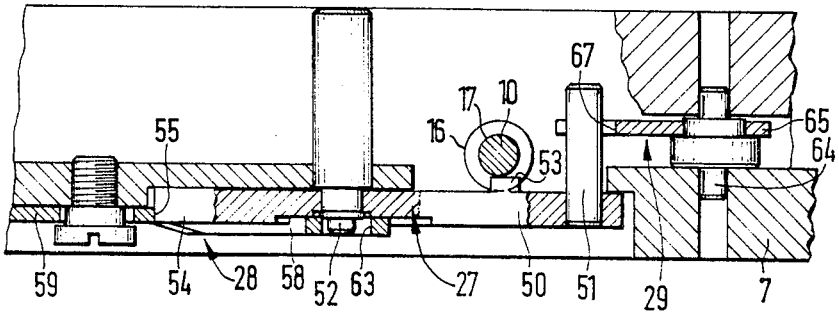

In the case of the clock shown in the figures, there is involved a wristwatch which has a clockwork 1, for example, a crystal-controlled clockwork. In addition to drive and continuous switching elements well-known per se, the watch has time indicators such as hands (not shown) as well as a date indicator ring 2 and a week day indicator ring 3 which can be actuated or reset, as the case may be. These two indicator rings 2, 3 are likewise only shown in part in the figures for the sake of clarity. The date numbers or week day abbreviations printed on these indicator rings are, as shown in FIG. 5, always readable in pairs through an associated view window 4 (FIG. 5) which is molded into the instrument dial 5.

The two indicator rings 2, 3 can be rotated and are arranged concentrically with respect to a central plate 6 (FIG. 1) seated in the clockwork 1. They are axially supported at least in part on a bottom plate 7 visible in FIG. 5. Each one of the two indicator rings 2, 3, has, in addition, a gear-tooth system 8, 9, respectively. These gear-tooth systems 8, 9, are shown in FIGS. 1 to 4 by lines always marking the dedendum circle or addendum circle, respectively. The structure of these gear-tooth systems is well known. They can consist of teeth of conventional type or also be composed of pin-shaped teeth.

Following is a description of the adjusting mechanism according to the invention.

An adjusting shaft 10 projects in a well-known manner from a clock casing (not shown) and can be actuated from the outside by means of a winding knob (not shown). This adjusting shaft 10 can (as shown, more particularly, in FIG. 5) assume three axial positions. In a first axial position 11, which corresponds to the normal position of the adjusting shaft 10, the latter is completely pressed-in. This axial position 11 is hereafter called the "selecting position".

A second axial position 12 corresponds to a first retracted position of the adjusting shaft. The latter is hereafter designated as the "working position".

The first and second positions 11 to 12 of the adjusting shaft have a considerable significance for the adjusting mechanism according to the invention.

Further, the adjusting shaft 10 can also assume a third axial position 13 corresponding to a second retracted position. The hands can be adjusted by the shaft in this third position. For this purpose, the adjusting shaft 10 has on its inside end a hand-setting drive 14 molded onto it by means of which it meshes into the gear-tooth system of a hand turning wheel 15 (FIG. 5) in a second retracted position 13. Further components of the hand adjusting drive are not shown.

Furthermore, the adjusting shaft 10 has a cylindrical stem 16, an annular tee slot 17 for locking-in a part of the adjusting mechanism according to the invention (not further described below) and a drive part 18 with, for example, a four- or six-cornered cross section. On this drive part 18 of the adjusting shaft, an adjusting wheel 19 is keyed for common rotation. This adjusting wheel 19 is supported axially in both directions by the walls of an opening 20 (FIG. 5) of the bottom plate 7. The connection of drive part 18 and adjusting wheel 19 has some play in each direction so that the shaft 10 can be easily adjusted axially with respect to the adjusting wheel 19 which can be moved only slightly in the axial direction. With the gear-teeth system of the adjusting wheel 19 there meshes continuously an intermediate wheel 21 which is supported so that it can be turned on a bearing bush 22 (FIG. 5) welded onto the bottom plate 7, the bush being secured by a screw 23.

Further, the adjusting mechanism, according to the invention, includes a selector mechanism and a control mechanism.

The selector mechanism comprises a path-bound movable continuous switching wheel 24 (FIG. 1) which is confined for travel in preselected paths as will be discussed and a selector slide 25 which is supported in clockwork 1 so it can be moved transversely with respect to the adjusting shaft 10.

The control mechanism comprises a control lever 26 (FIG. 1), a toggle lever 27, a toggle lever spring 28, an adjusting lever 29 and a positioning spring 30.

The selector slide 25 is constructed as a planar plate. It has a slotted hole 31 constructed in an S-shape and whose side walls form control curves for the movement of the continuous switching wheel 24 explained still more in detail further below. Further, the selector slide features two additional slotted holes 32 and 33 which extend perpendicular to the adjusting shaft. These slotted holes 32 and 33 are penetrated by guide elements of which the first is the bearing bush 22 associated with slotted hole 32 and supporting the intermediate wheel 21. The second guide element is associated with the longitudinal slot 33 and is in the form of a guide pin 34. Further, the selector slide 25 includes a flexible stopping arm 35 which extends essentially parallel to the two longitudinal slots 32, 33, and which features two stop recesses, namely an inner one 36 and an outer one 37. These two stop recesses 36,37 interact with a cylindrical stop element 38 which is formed by the stem of a screw 39 which aids in holding down the selector slide against its supporting surface.

The two stop recesses 36, 37 represent the two selector end positions in which the selector slide 25 can be moved in two directions transversely to the selector shaft. At the same time, by means of the control curves in the longitudinal slot 31, the continuous switching wheel can be moved into the one or the other of two possible selector positions.

It will be appreciated that the selector slide 25 could also feature one further stop recess between the two above-mentioned stop recesses 36 and 37 which could represent a neutral position of the selector slide 25 between its two selector end positions.

Furthermore, the selector slide 25 also features one more notch 40 which is arranged above the adjusting shaft. Into this notch 40 projects the control lever 26 which lies essentially on the same plane as the selector slide 25 and interacts with side walls 41 or 42, respectively, of the notch 40 in order to move the latter.

The control lever 26 is arranged for movement with a flexible bearing bracket portion 43 of the toggle lever spring 28. In addition, the control lever 26 has a control finger 44 on its side facing the control shaft 10 which, when the control shaft 10 is in the selector position 11, meshes with the control wheel 19 supported on the latter. By means of this gear connection, the control lever 26 is driven by turning the control shaft 10 (located in selector position 11) wherein it is always driven in one or the other direction, i.e., swung according to the particularl rotation direction of the shaft 10. In response, the selector slide 25 is simultaneously shifted in one or the other direction until stopped by cooperation of the stop element 38 and stop recess 36 or 37. The flexible bearing bracket 43 includes a supporting part 45 by means of which it is supported on a clockwork part, thus limiting the meshing depth of the control finger 44 with respect to the adjusting wheel 19. Further, on this bearing bracket 43 of the toggle lever spring 28, there are also provided two stop surfaces 46 (FIG. 1) which engage the finger 44 to retain the control lever 26 in either of its two positions of slide adjustment. Finally, the bearing bracket 43 also features additionally a control curve 47 against which bears a peripheral cam 48 of the toggle lever 27.

This peripheral cam 48 is arranged on a first arm 49 of the three-armed toggle lever 27. A second arm 50 of the latter has at its outer end a cam 51 constructed as a pin which functions to turn the adjusting lever 29. Further, on the stated second arm 50, about in the center of the distance between a toggle lever-bearing bolt 52 and the cam 51, is provided a further cam 53. This cam 53 projects into the annular tee slot 17 of the adjusting shaft 10 whereby the toggle lever 27 is connected to and drivable by the adjusting shaft 10 such that it is swingable around the axis of its bearing bolt 52 by axial movement of the shaft 10.

A third arm 54 of the toggle lever 27 functions as a stopping arm by means of which the toggle lever 27 can be stopped according to the location of the arm 54 in one of two stop recesses 55 or 56, respectively, arranged on the toggle lever spring 28.

The two stop recesses 55, 56, are integral with a central part 59 of the toggle lever spring 28 as are the bearing bracket 43, a spring arm 57 and a guide arm 58. The spring arm 57 is prestressed in the form of an arc and is fixedly secured at its outer broadened end 60. The toggle lever spring 28 lies at least in part on the bottom plate 7 and is axially secured by means of a screw 61. The stem of this screw 61 penetrates a slotted hole formed in a central area 59 of the toggle lever spring 28. A further slotted hole 63 in the guide arm 58 is penetrated by the bearing bolt 52 of the toggle lever 27 and prevents turning of the toggle lever spring 28.

The direction and size of the two slotted holes 72, 73, are determined such that the toggle lever spring 28 can yield sufficiently far toward the end 60 against the power of the spring arm 57 in order to enable a swinging of the toggle lever 27 from one stop recess 55 or 56, respectively, into the other.

The adjusting lever 29 is constructed as a toggle lever which can be tilted around a rotary axis 64 and arranged on the side of the bottom plate 7 located opposite from the selector slide 25. The adjusting lever 29 has on the outer end of its one arm 65 an abutting edge 66 as well as a jawshaped opening 67. The cam pin 51 of the toggle lever 27 engages the edge 66 or the opening 67, according to the position of the toggle lever 27. A second arm 68 of the adjusting lever 29 carries on its outer end a trip cam 69 with control surfaces 70 and 71 oriented at an obtus angle. The trip cam 69 interacts when turning the adjusting lever 29 with the rear end of a bearing shaft 72.

Figure 7:
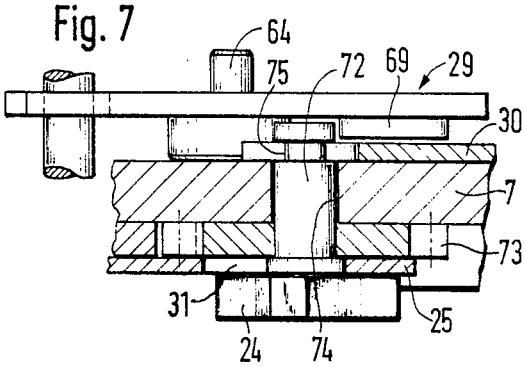

This above-mentioned bearing shaft 72 carries, as can be seen more particularly in FIG. 7, at its upper end, the continuous switching wheel 24 constructed as a star wheel. The continuous switching wheel 24 is connected to the bearing shaft 72 for rotation therewith and is arranged over the selector slide 25 in the plane of the gear-teeth 8, 9, of the date indicator ring 2 and week day indicator ring 3. In order to enable a drive transmission from the adjusting shaft 10 through the adjusting wheel 19 and intermediate wheel 21 to the continuous switching wheel 24, a continuous switching pinion 73 is assigned to the latter.

This continuous switching pinion 73 is secured to the bearing shaft 72 for rotation therewith and is arranged under the selector slide 25 in the plane of the intermediate wheel 21.

The bearing shaft 72 itself is supported so that it can be moved transversely in a curved slot 74 of the bottom plate 7. The curve of this slot 74 is coaxial with the axis of the intermediate wheel 21 and in such a radial distance from the latter that the continuous switching pinion 73 meshes continuously with the intermediate wheel 21 regardless of its actual position.

Further, the bearing shaft 72 has, under the bottom plate 7, a radial slot 75 which receives the outside forked end of the positioning spring 30 in order to support the bearing shaft 72.

The following now describes the operation of the adjusting device according to the invention, on the basis of FIGS. 1 to 4.

Figure 4:
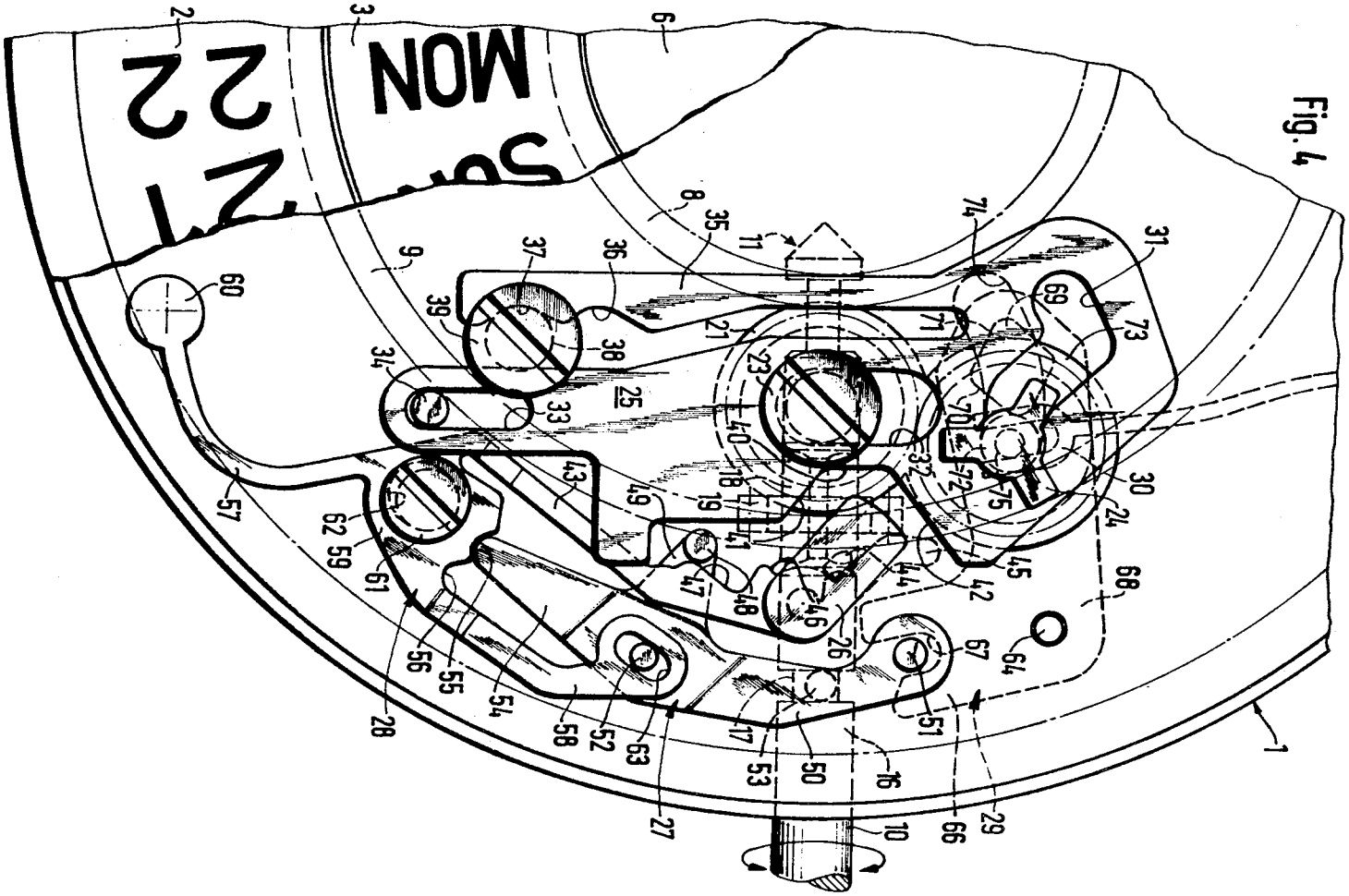

It should be initially assumed that the user of the watch first of all indeed knows in which direction he has to turn the adjusting shaft found in the selector position 11 for an adjustment of the date indication or the week day indication. A turning of the adjusting shaft 10 to the left (counter to the direction of the clock hand) serves to make it possible to adjusted the week day indication by a subsequent retraction of the shaft 10 to the working position 11. On the other hand, by turning the shaft to the right (in the direction of the clock hand), in the case of the form of construction disclosed herein, makes possible an adjustment of the date indication by a subsequent retraction of the shaft 10 to the working position 12. That is, when the shaft 10 is in the selector position 11 (FIG. 1), the user can select (by a corresponding winding of the shaft in one or the other direction) which type of adjustment (i.e., day of week or date) is to be made possible by a subsequent retraction of the shaft 10 to the working position (FIG. 2 or FIG. 4). The user, however, knows before this turning of the adjusting shaft nothing concerning the actual position of the individual parts of the adjusting device according to this invention.

For example, the individual parts of the adjusting device according to the invention described beforehand and represented in FIG. 1 all stand in a selector position for a "week day" indication adjustment because the user has turned the shaft 10 in the appropriate direction (i.e., to the left) to position the control lever 26 and thus the selector slide 25 in a position whereby the bearing shaft 72 is located at a respective place in the slot 31 of the slide 25. An indication will be provided to the user that the selection process is finished because if the user further turns the adjusting shaft 10 while in the selector position 11 in the direction for a week day indication adjustment (corresponding to the direction of the arrow shown in FIG. 1) he ratchets the control finger 44 of the control lever 26 (which meshes with the control wheel 19) as permitted by a lateral deflection of the bearing bracket 43 of toggle lever spring 28. This ratcheting produces an acoustically perceptible noise which indicates to the user that the selection process has ended.

By thereafter shifting the adjusting shaft 10 from the selector position 11 into the working position 12, which corresponds to the first retracted position, all individual parts of the adjusting device according to the invention assume the positions show in FIG. 2 which make possible a week day adjustment. In this regard, the following sequence of motions takes place.

When pulling out the adjusting shaft 10 from the selection position 11 into working position 12, the toggle lever 27, which is linked to the adjusting shaft 10 by means of cam 53, is turned around its bearing bolt 52. At the same time, the third arm 54 of the toggle lever 27 disengages from the stop recess 56 against the pressure of the yielding toggle lever spring 28 and by forcibly sliding back the toggle lever spring 28, enters into the stop recess 55. At the same time, the peripheral cam 48 arranged on the first arm 49 of the toggle lever 27 slides along the control curve 47 of the toggle lever spring-bearing bracket 43, whereby this bracket 43 is laterally deflected and disengages the control finger 44 of control lever 26 from the gear-teeth of the control wheel 19. In addition, during this process, the adjusting lever 29 is tilted around its rotary axis 64 by the cam 51 of the second toggle lever arm 50. At the same time, the trip cam 69 (FIG. 7) seated on the arm 68 of the adjusting lever 29, impacts against the lower end of the bearing shaft 72 and moves this shaft 72 within the slotted hole 31 of the selector slide 25, into its end area corresponding to the position shown in FIG. 2. By this movement of the bearing shaft 72, the positioning spring 30 is simultaneously deflected; in addition, the continuous switching pinion 72 is displaced and the continuous switching wheel 24 is displaced from its previous neutral or preliminary selector and into mesh with the gear-teeth system 8 of the week day indicator ring 3, i.e., into a final location.

According to the above-described process produced by the sliding out of the adjusting shaft, all parts of the adjusting mechanism according to the invention are held in the now-assumed position. More particularly, the continuous switching wheel 24 cannot deviate from its new operating connection so that, from now on, the week day indicator can be corrected forward or backward by the user by turning the adjusting shaft in a desired direction. This movement transmission takes place from the adjusting shaft 10 through adjusting wheel 19, the intermediate wheel 21, the intermediate switching pinion 73, and the intermediate switching wheel 24, to the gear-teeth of the week day indicator ring 3.

When the adjusting process is completed and the user presses the control shaft 10 into its selector position 11, the previously described process is reversed due to the positive linking of the individual components. As soon as the adjusting shaft has again assumed its selector position 11, these individual parts of the adjusting device according to the invention again assume their position described in FIG. 1.

Figure 3:
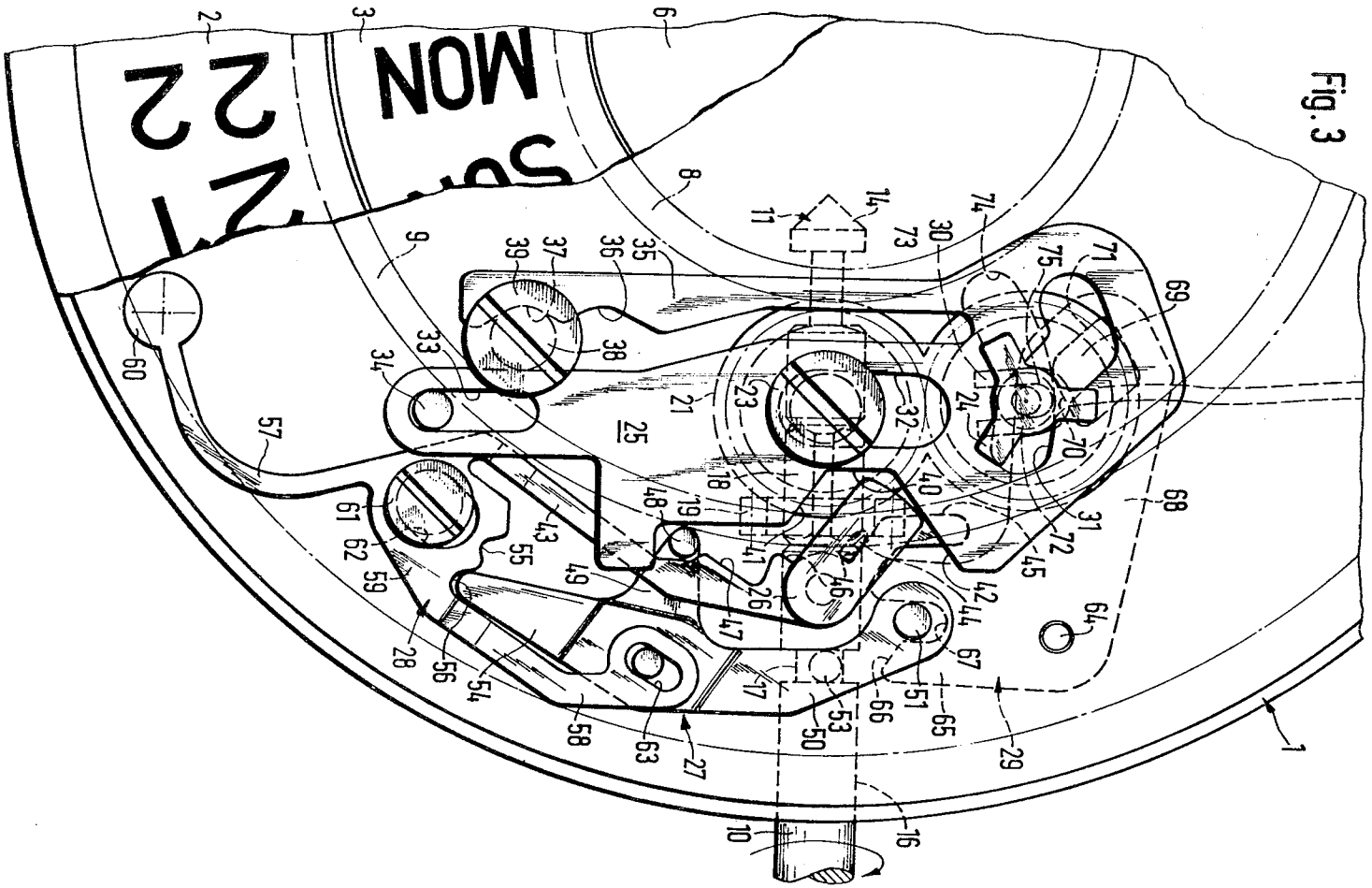

Starting from a position according to FIG. 1, the functional sequence for a date correction is described in the following on the basis of FIGS. 3 and 4.

Figure 1:
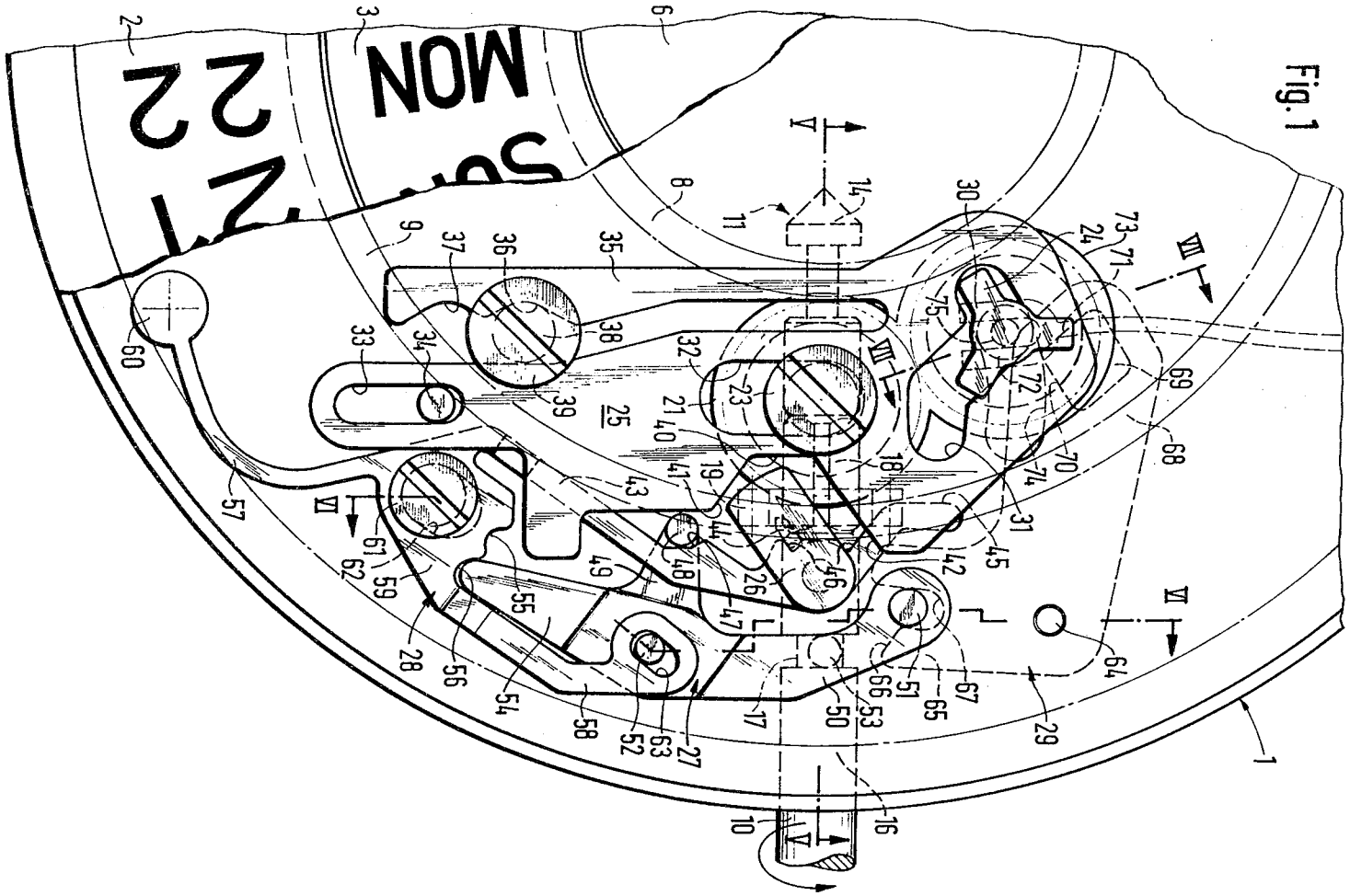
Figure 2:
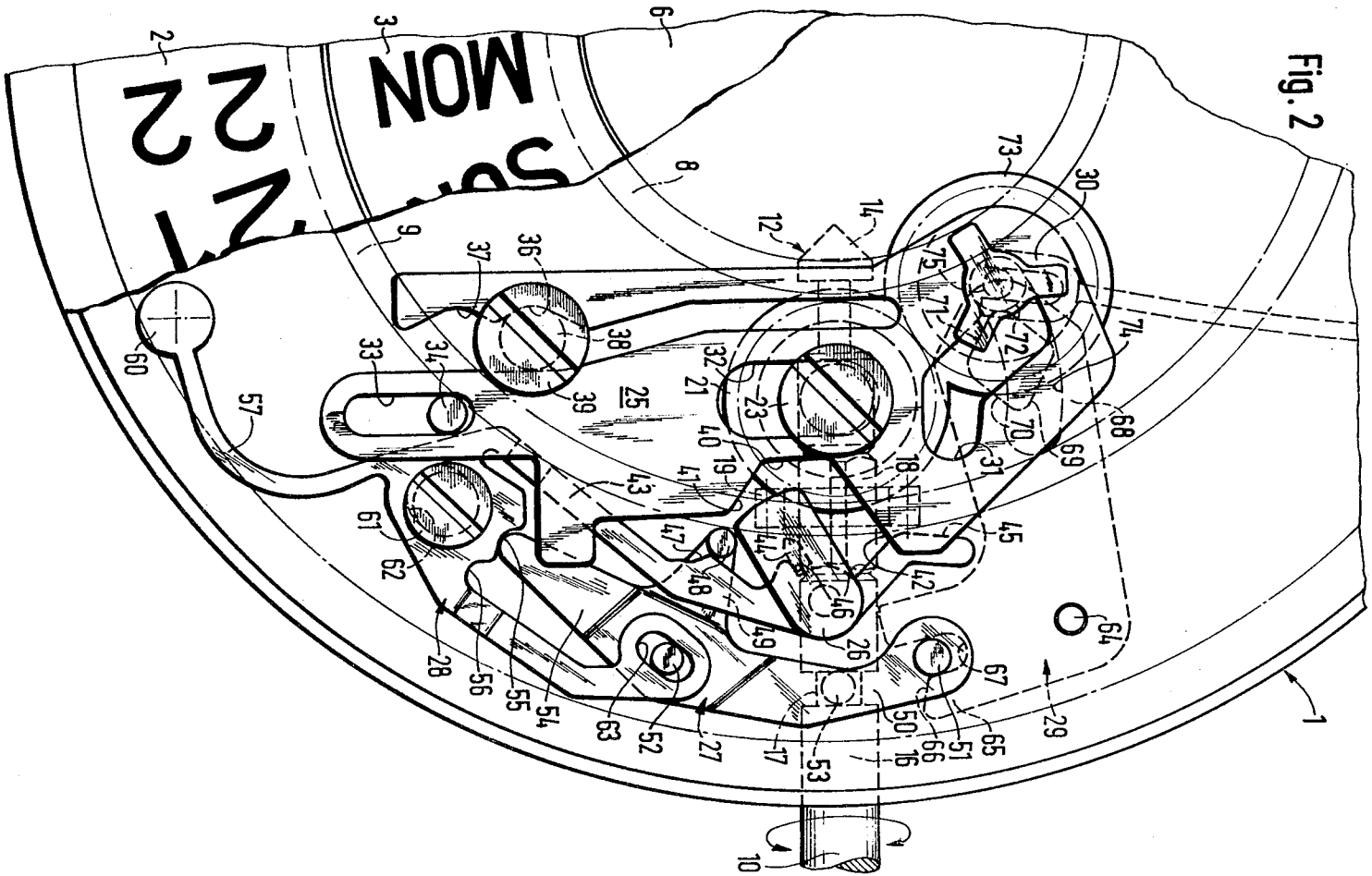

If the user of the clock wants to correct the date indicator, he first turns the adjusting shaft 10 located in the selector position in the corresponding direction according to the arrow direction shown in FIG. 1. By so doing, the control lever 26 is driven by the control 44 (which engages the adjusting wheel 19) and is moved from the position shown in FIG. 1 into the position shown in FIG. 3 within its rotation angle area limited by stops 46. After ending this swiveling process, further twisting of the control shaft creates a ratcheting of the control finger via the gear-tooth system of the control wheel, thereby producing an acoustically perceptible tone which indicates to the user that the end of the selection process has been reached. By swiveling the control lever 26, the selector slide 25 is shifted from its position shown in FIG. 1 into the position according to FIG. 3 whereby it disengages from its previous stop recess 36 and subsequently is engaged by stop recess 37. With this movement process, the bearing shaft 72 is shifted along with the continuous switching pinion 73 and the continuous switching wheel 24 along the control surfaces of the S-shaped slotted hole 31 on the selector slide 25 and in slotted hole 74 of bottom plate 7. The continuous switching wheel 24 is thus engaged in a second neutral or preliminary selector location (FIG. 3) in which it likewise, as in the selector position shown in FIG. 1, either engages into the gear-tooth system 8 of the week day indicator ring 3 or into the gear-tooth system 9 of the date indicator ring 2.

With subsequent retraction of the adjusting shaft 10 from the selector position 11 into the working position 12 according to FIG. 4, the toggle lever 26 including its parts, viz., the toggle lever spring 28 and its parts as well as the adjusting lever 29, again complete the same movements as in the case of the previously described week day adjustment process and again assume the same positions as in FIG. 2.

The date adjustment process differs only by the type of movement of the bearing shaft 72 with the continuous switching wheel 24 and the continuous switching pinion 73. In this regard, the bearing shaft 72 is swiveled into the working position from its previously accepted selector position by control surface 70 of the trip cam 69 arranged on the adjusting lever 29. At the same time, the bearing shaft slides within the slotted hole 74 (in bottom plate 7) and the S-shaped bent slotted hole 31 of the selector slide as far as its actual outer end. With this process, the positioning spring 30 is also further deflected laterally, and additionally, the continuous switching pinion 73 is swiveled along with it and the continuous switching wheel 24 is swiveled into a final location in mesh with the gear-teeth 9 of the date indicator ring 2.

In addition, by the process produced by such retracting of the adjusting shaft, all parts of the adjusting device according to the invention are mutually held in the newly assumed position. The continuous switching wheel 24 cannot deviate from its operating connection so that the user can adjust the date indication forward or backward in a direction as desired following drawing out of the adjusting shaft 10 by rotation of the same. The movement transfer by the adjusting shaft to the date indicator ring 2 also takes place with this adjustment process by the same gear wheels as with the week day adjustment process.

When again forcing the adjusting shaft 10 into its selector position after completion of this adjustment process, the process also previously described here with the individual elements of the adjustment device again takes place in the opposite direction. Again pressed into the selector position, the elements of the adjusting device according to the invention have again assumed their old position according to FIG. 3.

In conclusion, it remains to be pointed out that the invention is not exclusively restricted to the form of construction described but, further construction variants are possible in connection with the invention.

Although the invention has been described in connection with a preferred embodiment thereof, it will be appreciated by those skilled in the art, that additions, substitutions, deletions, and modifications not described may be made without departing from the spirit and scope of the invention as defined in the appended claims.

What is claimed is:

1. In a clock of the type including a day-of-week indicator ring and a date indicator ring, an adjusting shaft axially movable between at least a mode selection position and a working position, a mode selecting mechanism operably connected to the shaft and actuated by rotation of the shaft in its selection position for selecting one of the indicator rings for adjustment, and an adjusting mechanism responsive to rotational movement of the shaft in its working position for adjusting the one of the indicator rings selected for adjustment, the improvement wherein:

the selecting mechanism comprises a displaceable toothed switching wheel and a selector slide;

the selector slide being generally connected to the shaft for displacement in response to axial movement of the shaft between its mode selection and working positions;

the selector slide including control curve means displaceable with the selector slide for positioning the switching wheel in either of two preliminary locations in response to rotation of the shaft in a corresponding direction while in its mode selection position, one of the preliminary locations corresponding to a date adjustment mode and the other preliminary location corresponding to a day of week adjustment mode; and the adjusting mechanism comprising means responsive to axial movement of the shaft from its mode selection position to its working position for shifting the switching wheel into one of two final locations determined by the preliminary location of the switching wheel;

one final location constituting a date adjusting location wherein the switching wheel meshes with a toothed periphery of the date ring; and the other final location constituting a day of week adjusting location wherein the switching wheel meshes with a toothed periphery of the day of week ring.

2. Apparatus according to claim 1 wherein a toothed adjusting wheel is mounted on the shaft for rotation therewith, the shaft being axially movable relative to the adjusting wheel, the adjusting mechanism further comprises a toothed pinion connected to the switching wheel, a toothed intermediate wheel continuously meshing with the pinion and with the adjusting wheel such that rotation of the shaft in working position produces rotation of the switching wheel, the selecting mechanism further comprising a control lever mounted for rotation and engageable with the selector slide, the control lever including means meshing with the adjusting wheel when the latter is in its selection position such that rotation of the shaft slides the selector slide to place the switching wheel in one of said preliminary locations, the control lever being disconnected from the adjusting wheel when the shaft is in the working position.

3. Apparatus according to claim 2 wherein the selector slide comprises a flat plate and includes a generally S-shape slot which defines said control curve means, and a plurality of additional slots which receive guide means for defining the limits of the sliding movement of the selector slide, the selector slide further including a flexible stopping arm having at least two stop recesses which receive a stationary stop for locating the selector slide in either of two places which correspond to said preliminary locations of the switching wheel, the selector slide including a notch within which the control lever extends to displace the selector slide.

4. Apparatus according to claim 2 including a toggle lever spring having a flexible bearing bracket with two stops, the control lever being rotatably mounted on said bearing bracket and releasably engageable in the stops corresponding to the preliminary locations of the switching wheel; a three-armed toggle lever including a first arm with a cam engaging a control curve of the bearing bracket, a second arm operably connected with the shaft to be displaced in response to axial movement thereof to shift the control lever into and from meshing engagement with the adjusting wheel by means of the engagement of the cam and the control curve, and a third arm engageable in either of two stop recesses on the toggle lever spring to retain the control lever in its meshing or non-meshing relationship relative to the adjustment wheel; and an adjusting lever being provided which constitutes part of the adjusting mechanism and which is operably connected to the second arm of the toggle lever spring and to the switching wheel to shift the latter to its final location in response to axial movement of the shaft from its selection position to its working position.

5. Apparatus according to claim 4 wherein the toggle lever spring includes a spring arm fixed at its outer end to yieldably urge the stop recesses into engagement with the second arm of the three-armed toggle lever, the toggle lever spring including a plurality of slots which receive guides to limit movement of the toggle lever spring.

6. Apparatus according to claim 4 wherein the clock includes a bottom plate, the adjusting lever being rotatable about a fixed axis and positioned on a side of the bottom plate opposite that on which the selector slide is disposed, the adjusting lever including a first arm having abutment means, the second arm of the three-armed toggle lever including a cam which is engageable with the abutment means to swing the adjusting lever about its fixes axis in response to axial movement of the shaft between its selection and working positions and thereby shift the switching wheel into its final location.

7. Apparatus according to claim 2 wherein the switching wheel is formed as a star wheel and is coplanar with the teeth of both indicator rings, a bearing shaft mounted to the star wheel, the switching pinion being mounted on the bearing shaft for rotation therewith at a location beneath the selector slide; a bottom plate positioned beneath the pinion and including a curved slot in which the bearing shaft is displaceably mounted, the curvature of the slot being co-axial with the axis of the intermediate wheel such that the pinion remains in mesh with the intermediate wheel in all locations of displacement.

8. Apparatus according to claim 4 wherein the switching wheel is mounted on a bearing shaft, the adjusting lever includes an arm having a trip cam thereon which has control surfaces oriented at an obtuse angle relative to one another and which engage the bearing shaft to shift the switching wheel from its preliminary location to its final location in response to axial movement of the shaft from its selection location to its working location, and to shift the switching wheel from its final location to its preliminary location in response to axial movement of the shaft from its working position to its selection position.

9. Apparatus according to claim 7 including a spring engageable with the bearing shaft for urging the switching wheel to a neutral position out of engagement with the teeth of the indicator rings.

* * * * *